US007818971B2

(12) United States Patent
Yamaguchi et al.

(10) Patent No.: US 7,818,971 B2
(45) Date of Patent: Oct. 26, 2010

(54) $CO_2$ COOLING AND HEATING APPARATUS AND METHOD HAVING MULTIPLE REFRIGERATING CYCLE CIRCUITS

(75) Inventors: Hiroshi Yamaguchi, Kyoto (JP); Katsumi Fujima, Tsukuba (JP); Nelson Mugabi, Ryugasaki (JP); Choiku Yoshikawa, Kashiwa (JP)

(73) Assignees: Mayekawa Mfg. Co., Ltd. (JP); The Doshisha (JP)

( * ) Notice: Subject to any disclaimer, the term of this patent is extended or adjusted under 35 U.S.C. 154(b) by 363 days.

(21) Appl. No.: 12/105,169

(22) Filed: Apr. 17, 2008

(65) Prior Publication Data

US 2008/0245505 A1 Oct. 9, 2008

Related U.S. Application Data

(63) Continuation of application No. PCT/JP2006/320566, filed on Oct. 16, 2006.

(30) Foreign Application Priority Data

Oct. 17, 2005 (JP) ..... 2005-302346

(51) Int. Cl.
*F25B 1/00* (2006.01)

(52) U.S. Cl. ..... 62/115; 62/510

(58) Field of Classification Search ..... 62/115, 62/228.3, 238.6, 333, 335, 379, 510, 513; 417/251, 286, 426
See application file for complete search history.

(56) References Cited

U.S. PATENT DOCUMENTS 5,109,678 A * 5/1992 Jaster et al. ..... 62/175
5,134,859 A * 8/1992 Jaster ..... 62/503

(Continued)

FOREIGN PATENT DOCUMENTS

JP 6-159826 A 6/1994

(Continued)

OTHER PUBLICATIONS

Search report issued in corresponding application No. PCT/JP2006/320566, dated Jan. 30, 2007.

*Primary Examiner*—Mohammad M Ali
(74) *Attorney, Agent, or Firm*—Rossi, Kimms & McDowell LLP

(57) ABSTRACT

A $CO_2$ cooling and heating apparatus and method permit simultaneous production of high-temperature heat source and low-temperature heat source having a temperature difference therebetween. The apparatus/method uses $CO_2$ (carbon dioxide) as a refrigerant, and has a first refrigerating cycle circuit where the refrigerant is compressed to a supercritical zone and then decompressed via an expansion device to a pressure/temperature level of the $CO_2$ triple point or below to thereby attain evaporation. The apparatus can include multistage compressors, intermediate cooler disposed in a first refrigerant flow path between a condenser and the expansion device. A second refrigerating cycle circuit having a second refrigerant flow path, which can branch off from the first refrigerant flow path or provided in an independent closed circuit, can be provided to carry out absorption of evaporation latent heat with the first refrigerant flow path to thereby maintain the pressure/temperature level of the $CO_2$ triple point (Ptr) or above. A third refrigerating cycle circuit having a third refrigerant flow path also can be provided to carry out heat exchange with the second refrigerant flow path.

18 Claims, 8 Drawing Sheets

U.S. PATENT DOCUMENTS

| | | | | |
|---|---|---|---|---|
| 5,191,776 | A * | 3/1993 | Severance et al. | 62/513 |
| 5,235,820 | A * | 8/1993 | Radermacher et al. | 62/114 |
| 6,568,198 | B1 * | 5/2003 | Tadano et al. | 62/217 |
| 6,698,234 | B2 * | 3/2004 | Gopalnarayanan et al. | 62/505 |
| 6,883,341 | B1 * | 4/2005 | Lifson | 62/196.4 |
| 6,923,011 | B2 * | 8/2005 | Manole | 62/149 |
| 7,131,285 | B2 * | 11/2006 | Lifson et al. | 62/196.4 |
| 7,228,707 | B2 * | 6/2007 | Lifson et al. | 62/510 |
| 7,320,228 | B2 * | 1/2008 | Kamimura et al. | 62/498 |

FOREIGN PATENT DOCUMENTS

| | | | |
|---|---|---|---|
| JP | 11-30599 | A | 2/1999 |
| JP | 2001-91074 | A | 4/2001 |
| JP | 2001-153476 | A | 6/2001 |
| JP | 2003-329318 | A | 11/2003 |
| JP | 2004-85099 | A | 3/2004 |
| JP | 2004-170007 | A | 6/2004 |
| JP | 2004-286289 | A | 10/2004 |
| JP | 2004-308972 | A | 11/2004 |

* cited by examiner

$CO_2$ COOLING AND HEATING APPARATUS AND METHOD HAVING MULTIPLE REFRIGERATING CYCLE CIRCUITS

This is a continuation of International Application PCT/JP2006/320566 having an international filing date of 16 Oct. 2006, which claims priority to JP 2005-302346 filed on 17 Oct. 2005. The disclosure of the priority application, in its entirety, including the drawings, claims, and the specification thereof, is incorporated herein by reference.

BACKGROUND

A dual cooling device, comprising two refrigerating cycles of a high-temperature side and a low temperature side cycles, has been used to supply cooling fluid cooled to a very low temperature, in the range of minus tens of degrees C. For example, Japanese Laid-Open Patent Application No. 2004-170007 (hereafter Reference 1) discloses a refrigerator system that uses combined ammonia and $CO_2$ refrigerating cycles, where its high-temperature side refrigerating cycle uses ammonia as a refrigerant and its low-temperature side refrigerating cycle uses $CO_2$ as a refrigerant cooled and liquefied by a cascade condenser. A cooling fluid of a very low temperature, lower than the triple point temperature of $CO_2$ (−56° C.), can be produced by cooling the cooling fluid with the $CO_2$ refrigerant, which has a lower temperature than the triple point temperature of $CO_2$, by allowing the $CO_2$ refrigerant in the low temperature refrigerating cycle to expand to the pressure/temperature level of the $CO_2$ triple point or below. The $CO_2$ refrigerant is reduced to a two-phase mixture of solid $CO_2$ and $CO_2$ gas by means of an expansion valve provided downstream of the cascade condenser for cooling the $CO_2$ refrigerant.

Japanese Laid-Open Patent Application No. 2004-308972 (hereafter Reference 2) discloses a $CO_2$ refrigerator comprising compressors for compressing a $CO_2$ refrigerant to a saturation or supercritical pressure, an expansion device for decreasing the pressure of condensed $CO_2$ refrigerant from a condenser to the pressure/temperature level of the $CO_2$ triple point or below so that the $CO_2$ refrigerant is reduced to a two-phase mixture of solid $CO_2$ and $CO_2$ gas, and a sublimation heat exchanger for allowing the solid $CO_2$ to sublimate by receiving heat from cooling fluid from cooling loads and send the sublimated $CO_2$ gas to the compressors. Further, a cascade heat exchanger cools the high-pressure $CO_2$ gas in the condenser with the refrigerant of a high-temperature side refrigerating cycle such as an ammonia refrigerating cycle.

Although References 1 and 2 disclose supplying cooling fluid to cooling loads, a high-temperature heat source cannot be produced simultaneously. Further, as the $CO_2$ refrigerant is expanded to the pressure/temperature level of the $CO_2$ triple point to reduce the $CO_2$ refrigerant to a two-phase mixture of solid $CO_2$ and $CO_2$ gas, and the latent heat of sublimation of the solid $CO_2$ is used to cool the cooling fluid, the refrigerant flow path can clog or the refrigerant flow path can lose pressure, resulting in unstable operation of the refrigerator.

Accordingly, there remains a need for a $CO_2$ cooling and heating apparatus (hereafter sometimes referred to simply as the apparatus) having an improved coefficient of performance with stable operation control, and capable of producing a high-temperature heat source and a low temperature cold heat source simultaneously by effectively taking the advantages of $CO_2$. A $CO_2$ refrigerant is, not only environmentally friendly since its ozone depleting potential of zero, it is also innoxious, inflammable, and inexpensive. By utilizing the advantage of a heat pump cycle using a $CO_2$ refrigerant that it is very efficient in producing a hot-water supply. The present invention addresses this need.

SUMMARY OF THE INVENTION

The present invention relates to a cooling and heating apparatus and method having a plurality of refrigerating cycle circuits, with at least one of the circuits using $CO_2$ (carbon dioxide) as a refrigerant or a primary refrigerant.

According to the present invention, one of the refrigerating cycle circuits operates so that the $CO_2$ refrigerant is cooled to the pressure/temperature level of the $CO_2$ triple point or below to reduce $CO_2$ to a two-phase mixture of solid $CO_2$ and $CO_2$ gas, thereby producing a high temperature heat source and a very low temperature cold source simultaneously with stable control of operation and improved coefficient of performance.

One aspect of the present invention is a $CO_2$ cooling and heating apparatus. The apparatus can include first and second refrigerating cycle circuits. The circuit includes a first refrigerant flow path, a first compressor in the first refrigerant flow path for pressurizing a $CO_2$ refrigerant to the supercritical region of $CO_2$, a condenser in the first refrigerant flow path downstream from the first compressor for condensing the pressurized refrigerant, a first intermediate cooler in the first refrigerant flow path downstream of the condenser for further cooling the condensed refrigerant, a first expansion device in the first refrigerant flow path downstream of the first intermediate cooler for further cooling and condensing the refrigerant to a pressure/temperature level of the $CO_2$ triple point or below to reduce the refrigerant to a mixture of solid $CO_2$ and $CO_2$ gas, an evaporator in the first refrigerant flow path downstream of the first expansion device for sublimating the solid $CO_2$ in the mixture, a second compressor in the first refrigerant flow path downstream of the evaporator for compressing the refrigerant. The refrigerant compressed by the second compressor is introduced into the first compressor.

The second circuit can include a second refrigerant flow path including a first branch path branching off the first refrigerant flow path at a point between the condenser and the first intermediate cooler, a second expansion device in the second refrigerant flow path for further cooling and evaporating part of the refrigerant from the condenser, the first intermediate cooler also in the second refrigerant flow path for further cooling the refrigerant in the first refrigerant flow path and for evaporating the refrigerant in the second refrigerant flow path by heat exchange. The refrigerant passing through the second expansion device is introduced into the first intermediate cooler in the second refrigerant flow path, and the refrigerant passing through the first intermediate cooler is introduced to the first refrigerant flow path between the first compressor and the second compressor so that the second refrigerating cycle circuit operates above the pressure/temperature level of the $CO_2$ triple point.

The apparatus can further include a second intermediate cooler in the first refrigerant flow path between the first intermediate cooler and the first expansion device, a third compressor in the first refrigerant flow path between the first and second compressors, and a third refrigerating cycle circuit. The third circuit can include a third refrigerant flow path including a second branch path branching off the first refrigerant flow path at a point between the first intermediate cooler and the second intermediate cooler, a third expansion device in the third refrigerant flow path for further cooling and evaporating part of the refrigerant from the first intermediate cooler in the path of the first refrigerant flow path, the second intermediate cooler also in the third refrigerant flow path for further cooling the refrigerant in the first refrigerant flow path and for evaporating the refrigerant in the third refrigerant flow path by heat exchange. The refrigerant passing through the third expansion device is introduced into the first intermediate cooler in the third refrigerant flow path, and the refrigerant passing through the second intermediate cooler is introduced to the first refrigerant flow path between the second compressor and the third compressor so that the third refrigerating cycle circuit operates above the pressure/temperature level of the $CO_2$ triple point.

The first and second or first, second, and third compressors can be connected in series. The first expansion device can comprise an expansion valve, and the second or third expansion device can comprises a capillary tube or an expansion turbine. The condenser can be a heat exchanger that supplies heated water, and the evaporator can be a heat exchanger that supplies cooling fluid.

According to another embodiment, the apparatus can include first, second, and third refrigerating cycle circuits. The first circuit can include a first compressor for compressing a $CO_2$ refrigerant to the supercritical region of $CO_2$, a condenser for condensing the refrigerant compressed by the first compressor, a first expansion device for expanding the refrigerant condensed by the condenser, a first cascade condenser having an evaporating part for vaporizing the refrigerant expanded by the first expansion device. The first compressor compresses the refrigerant vaporized by the first cascade condenser to the supercritical region of $CO_2$ so that the first refrigerating cycle circuit operates above a pressure/temperature level of the $CO_2$ triple point.

The second circuit can include a second compressor for compressing a refrigerant of ammonia, HC, or $CO_2$, the first cascade condenser having a condensing part for condensing the refrigerant compressed by the second compressor, a second expansion device for expanding the refrigerant condensed by the first cascade condenser, and a second cascade condenser having an evaporating part for vaporizing the refrigerant condensed by the second expansion device. The second compressor compresses the refrigerant vaporized by the second cascade condenser so that the second refrigerating cycle circuit operates above the pressure/temperature level of the $CO_2$ triple point The third circuit can include a third compressor for compressing a $CO_2$ refrigerant, the second cascade condenser having a condensing part for condensing the refrigerant compressed by the third compressor, a third expansion device for expanding the refrigerant condensed by the second cascade condenser to the pressure/temperature level of the $CO_2$ triple point or below to reduce the refrigerant to a mixture of solid $CO_2$ and $CO_2$ gas, a sublimation heat exchanger for sublimating the solid $CO_2$. The third compressor compresses the refrigerant sublimated by the sublimation heat exchanger.

The apparatus can include a fourth refrigerating cycle circuit that uses a refrigerant of CH gas or air or nitrogen gas, and includes the sublimation heat exchanger, which comprises a third cascade condenser that sublimates the solid $CO_2$ in the third refrigerating cycle circuit.

Each of the first, second, and third cascade condensers can be a direct contact type heat exchanger where heat exchange occurs from a direct contact of a higher-temperature side refrigerant with a lower-temperature side refrigerant.

The apparatus can further include a closed circuit for receiving the refrigerant in liquid phase from the first or third refrigerating cycle circuit, and a refrigerant path provided with a heat exchanger connected to the closed circuit. The closed circuit can have a liquid phase line part and a gas phase line part. The liquid phase line part supplies the refrigerant in liquid phase to the heat exchanger, which vaporizes the refrigerant in liquid phase. The gas phase line part can return the vaporized refrigerant from the heat exchanger. The closed circuit can be provided for each of the first and third refrigerating cycle circuits. A gas-liquid separator can be in the closed circuit between the gas phase line part and the liquid phase line part.

The first, second, and third expansion devices each can be one of an expansion valve, a capillary tube, or an expansion turbine. The condenser can be a heat exchanger that supplies heated water, and the sublimation heat exchanger can supply cooling fluid.

Another aspect of the present invention is a method of cooling and heating fluid. The method includes providing at least first and second refrigerating cycle circuits, operating one of the first and second refrigerating cycle circuits with a $CO_2$ refrigerant to achieve a pressure/temperature level above the $CO_2$ triple point so that solid $CO_2$ is not produced, operating the other of the first and second refrigerating cycle circuits with a $CO_2$ refrigerant to achieve a pressure/temperature level of the $CO_2$ triple point or below to reduce $CO_2$ to a two-phase mixture of solid $CO_2$ and $CO_2$ gas, exchanging heat between the refrigerants in the first and second refrigerating cycle circuits to evaporate the refrigerant in the one circuit and evaporate the refrigerant in the other circuit, exchanging heat between the refrigerant in the one circuit and fluid to be heated to obtained heated fluid, and exchanging heat between the refrigerant in the other circuit and fluid to be cooled to obtain cooled fluid. The heated fluid and the cooled fluid are simultaneously obtained.

DETAILED DESCRIPTION

Preferred embodiments of the $CO_2$ cooling and heating apparatus will now be described with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
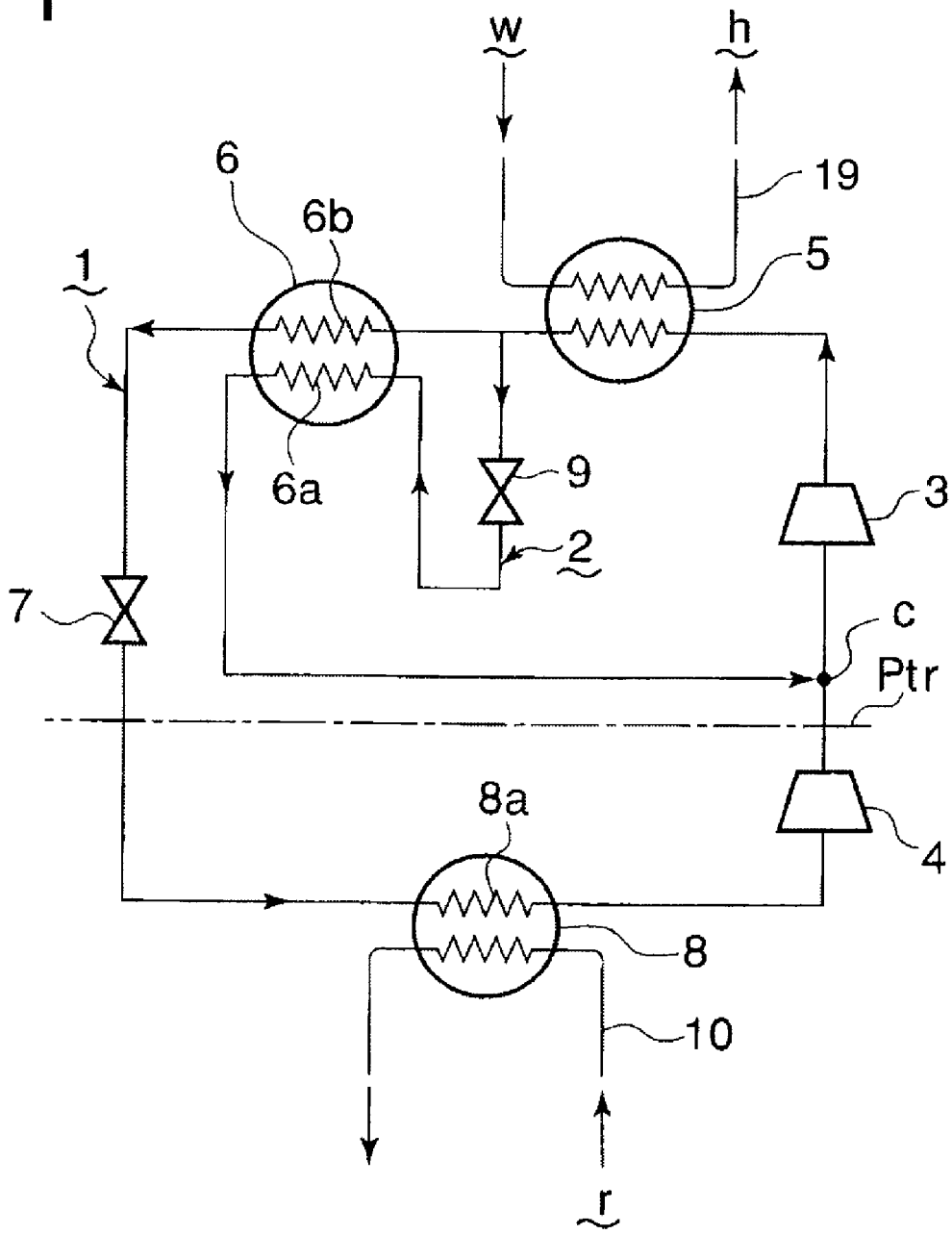
FIG. 1 is a block diagram of a first embodiment of a $CO_2$ cooling and heating apparatus according to the present invention.

Referring to FIG. 1, which shows the first embodiment, reference numeral 1 is a refrigerant flow path of a first refrigerating cycle circuit using $CO_2$ as a refrigerant, and 2 is a refrigerant flow path of a second refrigerating cycle circuit also using $CO_2$ as a refrigerant. Reference numeral 3 is a high-pressure stage compressor for both the first and second refrigerating cycle circuits, 4 is a low-pressure stage compressor for the first refrigerating cycle circuit, and 5 is a condenser for both the first and second refrigerating cycle circuits. Reference numeral 6 is an intermediate cooler. The refrigerant flow path 2 (hereafter referred to as the second refrigerant flow path) of the second refrigerating cycle circuit branches off from the refrigerant flow path 1 (hereafter referred to as the first refrigerant flow path) of the first refrigerating cycle circuit at a point upstream of the intermediate cooler 6 and is connected via an expansion valve 9 to an evaporating part 6*a* of the intermediate cooler 6 and to the first refrigerant flow path 1 at a point c upstream of the high-pressure stage compressor 3. The first refrigerant flow path 1 flows through a condensing part 6*b* of the intermediate cooler 6, through a sublimating part 8*a* of a sublimation heat exchanger 8 via an expansion valve 7, and to the inlet of the low-pressure stage compressor 4.

Reference numeral 19 is a hot-water supply line. The condenser 5 heats water supplied to the hot-water line 19. Heated water is sent to heating loads not shown in the drawing. Reference numeral 10 is a cooling fluid supply line. Cooling fluid r supplied to the cooling fluid supply line 10 is cooled in the sublimation heat exchanger 8, heating the $CO_2$ refrigerant to sublimate it and sent to cooling loads not shown in the drawing. Ptr indicates a $CO_2$ triple point line, below which the $CO_2$ refrigerant is low, below the triple point temperature thereof.

Figure 2:
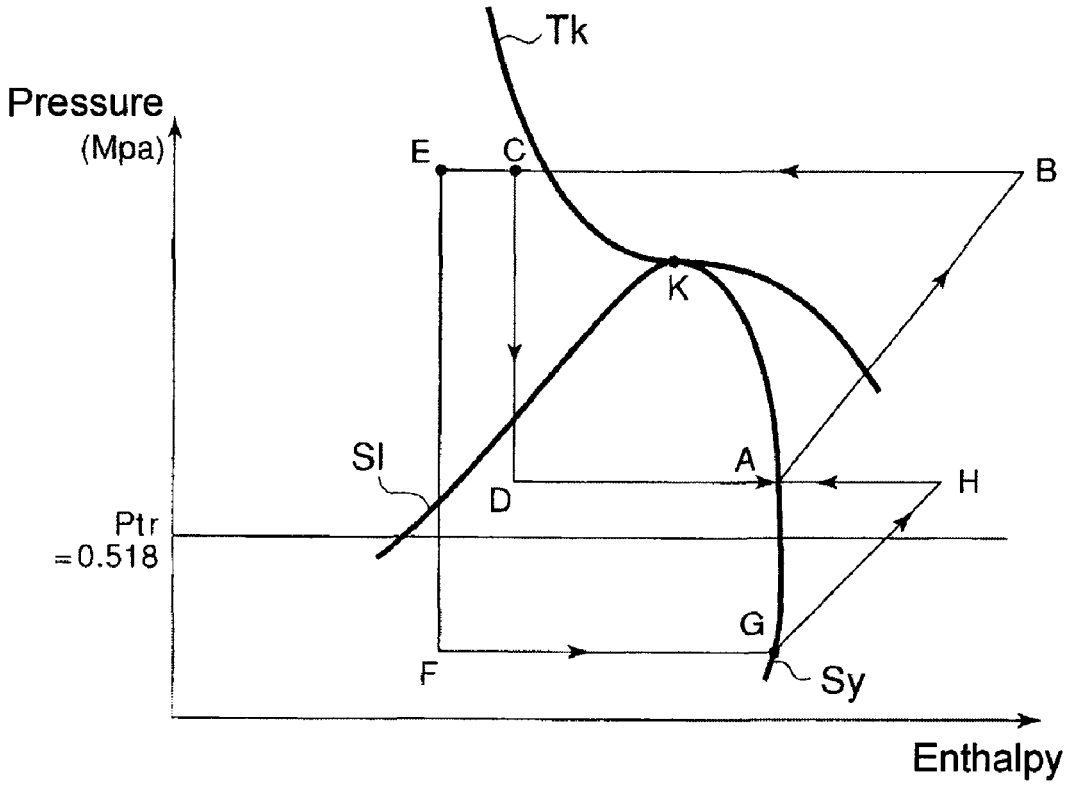
FIG. 2 is a pressure-enthalpy diagram of the first embodiment.

The operation of the first embodiment will be explained with reference to FIGS. 1 and 2. In FIG. 2, which shows a pressure-enthalpy diagram of the first embodiment, Sl is the saturated liquid line, Sy is the saturated vapor line, Tk is an isothermal line, and K is the critical point (critical temperature of 31.1° C. and critical pressure of 7.38 MPa). Ptr indicates the triple point pressure (0.518 MPa) of the $CO_2$ refrigerant. The high-pressure stage compressor 3 in the first refrigerating cycle circuit compresses the $CO_2$ refrigerant to a supercritical state (A→B in FIG. 2). Then, water w cools and condenses the refrigerant in the condenser 5 (B→C in FIG. 2). The refrigerant heats water w, by heat exchange, to about 80° C. Heated water h is supplied to heating loads not shown in the drawing via the hot-water supply line 9.

On the other hand, part of the cooled refrigerant is branched off from the first refrigerant path 1 at a point before the intermediate cooler 6 flows to the second refrigerating path 2 to be reduced in pressure (C→D in FIG. 2) via expansion via the expansion valve 9 and partially vaporized (flash evaporated) by the expansion flows into the evaporating part 6*a* of the evaporator 6. The other part of the refrigerant not branched off flows into the condensing part 6*b* of the intermediate cooler 6 for further cooling (C→E in FIG. 2) by the flash evaporated branched refrigerant flowing through the evaporating part 6*a* and removing heat from the refrigerant flowing in the condensing part 6*b*. The flash evaporated branched refrigerant is fully evaporated in the evaporating part 6*a* through receiving heat from the refrigerant flowing in the condensing part 6*b* and joins the refrigerant of the first refrigerating cycle circuit (D→A and H→A in FIG. 2). The pressure/temperature level above the $CO_2$ triple point (−56° C., 0.515 MPa) is maintained in the second refrigerant flow path 2.

The refrigerant flowing out from the condensing part 6*b* is expanded adiabatically (E→F in FIG. 2) through the expansion valve 7 and flows into the sublimating part 8*a* of the sublimation heat exchanger 8. The refrigerant is reduced in pressure and temperature to a pressure/temperature level below the $CO_2$ triple point and reduced to a state of mixed solid $CO_2$ and $CO_2$ gas. In the sublimation heat exchanger 8, the solid part of the $CO_2$ refrigerant is sublimated (F→G in FIG. 2) by heat received from the cooling fluid supplied to the sublimation heat exchanger 8 through the cooling fluid supply line 10. On the other hand, cooling fluid r is cooled to very low temperature of −56° C. (the triple point temperature)~−78° C. (saturated vapor temperature under atmospheric pressure). The refrigerant gas flowing out from the sublimation heat exchanger 8 is sucked into the low-pressure stage compressor 4 for compression (G→H in FIG. 2). Although not shown in FIG. 1, a cooler is provided between the low-pressure stage compressor 4 and the high-pressure stage compressor 3 to cool the $CO_2$ gas compressed by the compressor 4 to the temperature at A in FIG. 2.

According to the first embodiment, hot water of about 80° C. and cooling fluid of a very low temperature of −56° C. or lower can be produced simultaneously by allowing the apparatus using $CO_2$ as a refrigerant to operate a refrigerating cycle between the supercritical region of $CO_2$ and the low pressure/temperature region lower than the $CO_2$ triple point. As the pressure/temperature of the refrigerant is maintained higher than those of the $CO_2$ triple point in the second refrigerant flow path 2, solid $CO_2$ does not develop in the second refrigerant flow path 2, so that increase in flow resistance or clogging does not occur in the second refrigerant flow path 2. Further, as compression of refrigerant is performed in two stages, the coefficient of performance is increased. Moreover, the expansion valve 7, through which the refrigerant is expanded to the pressure/temperature of the $CO_2$ triple point or lower, is suitable to adopt a capillary tube or expansion turbine as the expansion device, by which increase in flow resistance or clogging in the first refrigerant flow path 1 can be prevented with certainty.

Figure 3:
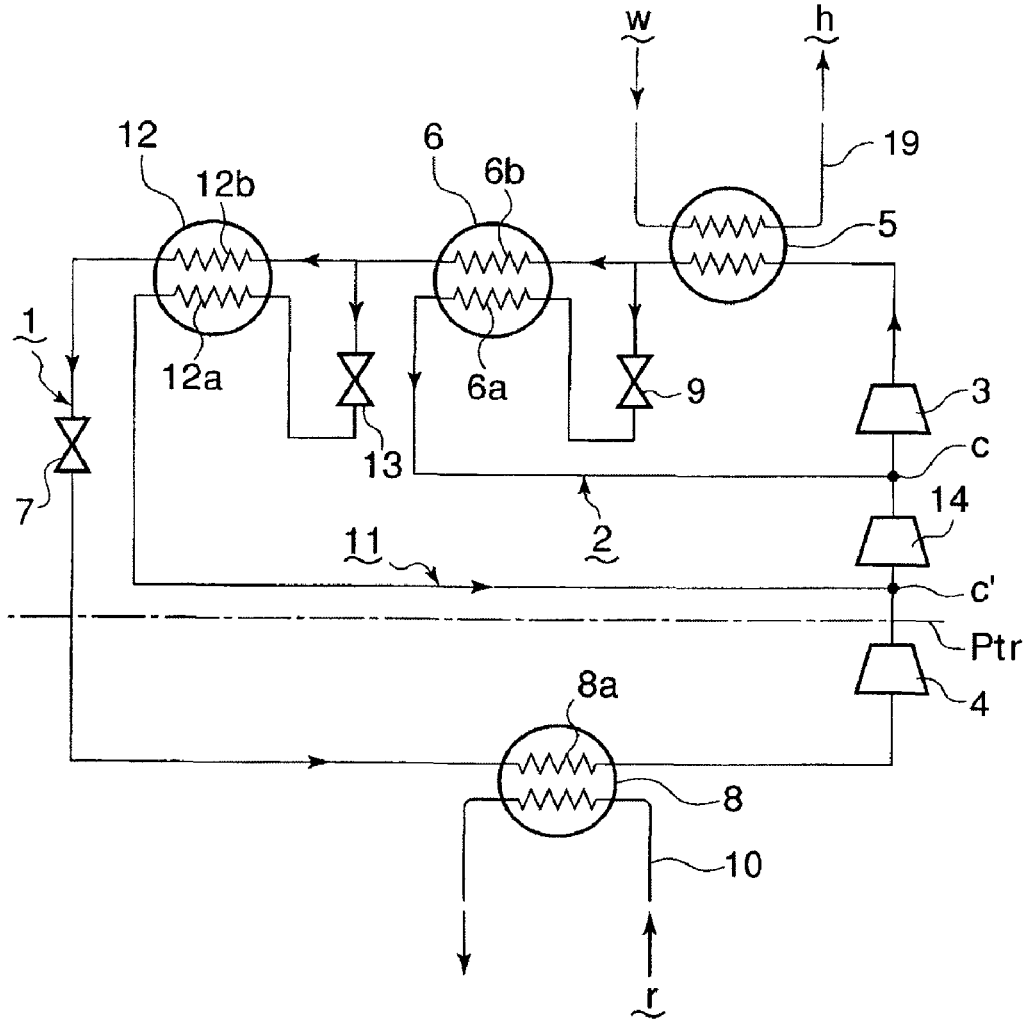
FIG. 3 is a block diagram of a second embodiment of the apparatus according to the present invention.
Figure 4:
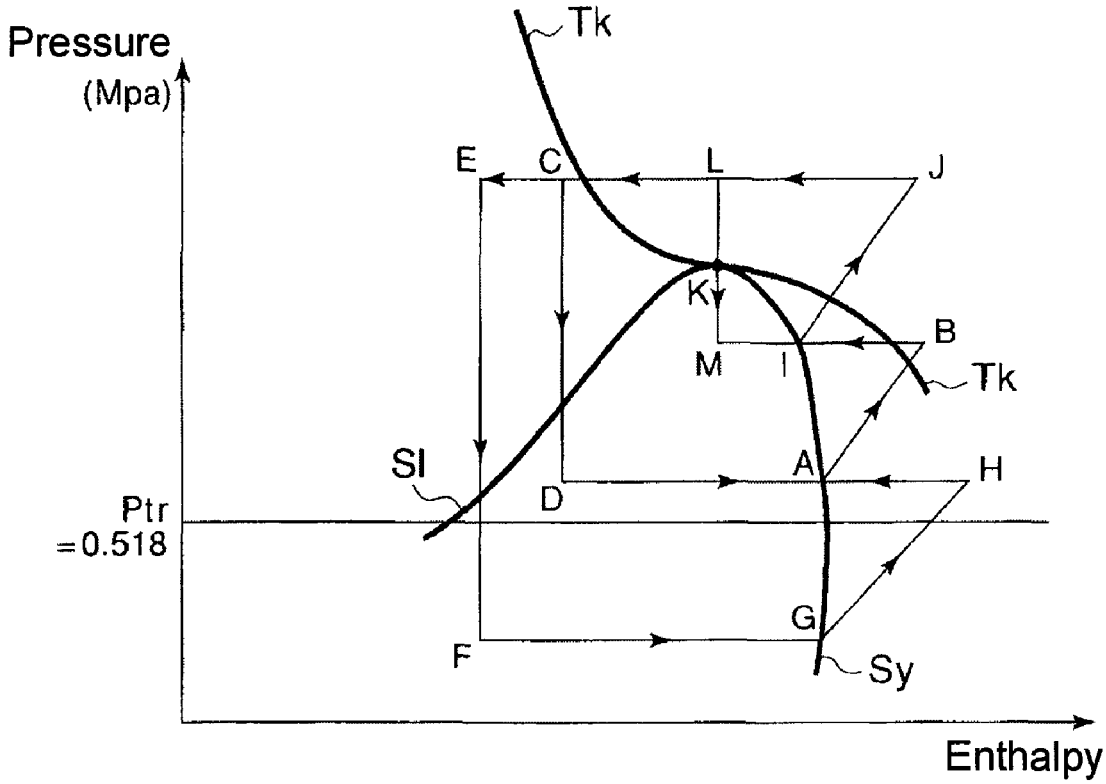
FIG. 4 is a pressure-enthalpy diagram of the second embodiment.

The second embodiment will be explained with reference to FIGS. 3 and 4. In the second embodiment, a third refrigerating cycle circuit is further added to the first embodiment. In FIGS. 3 and 4, devices and parts denoted with reference numerals the same as those of the first embodiment shown in FIG. 1 have the same construction and function as those in the first embodiment, and thus their explanation has been omitted. In the second embodiment, an intermediate-pressure stage compressor 14 is further included between the high-pressure stage compressor 3 and low-pressure stage compressor 4. A second intermediate cooler 12 is provided downstream of the intermediate cooler 6 in the first refrigerant flow path 1, and a refrigerant flow path 11 (hereafter referred to as the third refrigerant flow path) of the third refrigerating cycle circuit branches off from the first refrigerant flow path 1 at a point between the intermediate cooler 6 and second intermediate cooler 12. The refrigerant branched off to the third refrigerant flow path 11 is adiabatically expanded through an expansion valve 13 to be flash evaporated, and the flash evaporated refrigerant enters an evaporating part 12*a* of the second intercooler 12 for a full evaporation.

In the first refrigerant flow path 1, the refrigerant flowing through a condensing part 12*b* of the second intermediate cooler 12 is cooled by the branched and flash evaporated refrigerant flowing through the evaporating part 12*a*. On the other hand, the branched and flash evaporated refrigerant evaporates fully in the evaporating part 12*a*. The refrigerant vapor enters the first refrigerant flow path 1 at a point c' between the low-pressure stage compressor 4 and the intermediate-pressure stage compressor 14. A pressure/temperature level above the $CO_2$ triple point is maintained in the third refrigerant flow path 11.

The operation of the second embodiment will be explained with reference to the P-h diagram of FIG. 4. The high-pressure stage compressor 3 compresses the refrigerant to the supercritical region (I→J in FIG. 4). Then the compressed refrigerant is cooled (J→L in FIG. 4) through water w flowing through the condenser 5. The refrigerant cooled in the condenser 5 is introduced to the intermediate cooler 6 and then to the second intermediate cooler 12. Thus, the refrigerant is cooled in two stages (L→C and C→E in FIG. 4) and condensed. The condensed refrigerant is expanded through the expansion valve 7 to the pressure/temperature level of the $CO_2$ triple point or lower (E→F in FIG. 4).

On the other hand, the refrigerant branched before entering the intermediate cooler 6 and expanded through the expansion valve 9 flows into the evaporating part 6*a* of the intermediate cooler 6, where the branched refrigerant flash evaporated through the expansion is fully evaporated and joins the refrigerant from the high-pressure stage compressor 3 at point c (L→M→I in FIG. 4). The refrigerant branched before entering the second intermediate cooler 12 and expanded through the expansion valve 13 flows into the evaporating part 12*a* of the second intermediate cooler 12, where the branched and flash evaporated refrigerant is fully evaporated and joins the refrigerant from the intermediate-pressure stage compressor 14 at point c' (C→D→A in FIG. 4). Although not shown in FIG. 3, a cooler is provided between the low-pressure stage compressor 4 and intermediate-pressure stage compressor 14 to cool the $CO_2$ gas compressed by the compressor 14 to temperature at A in FIG. 4, and a cooler between the intermediate-pressure stage compressor 14 and the high-pressure stage compressor 3 to cool the $CO_2$ gas compressed by the compressor 4 to the temperature at I in FIG. 4.

According to the second embodiment, hot water h of about 80° C. and cooling fluid of a very low temperature of −56° C. or lower can be produced simultaneously as is with the first embodiment. In addition, as the refrigerant is compressed in three stages, the coefficient of performance is further increased.

In the first and second embodiments, the first and second (and third in the second embodiment) refrigerating cycle circuits share part of the first flow path as these circuits are not isolated from each. In the third, fourth, and fifth embodiments, however, each of the refrigerating cycle circuits are completely isolated from each other. That is, the different circuits do not share the same refrigerants as in the first and second embodiments.

Figure 5:
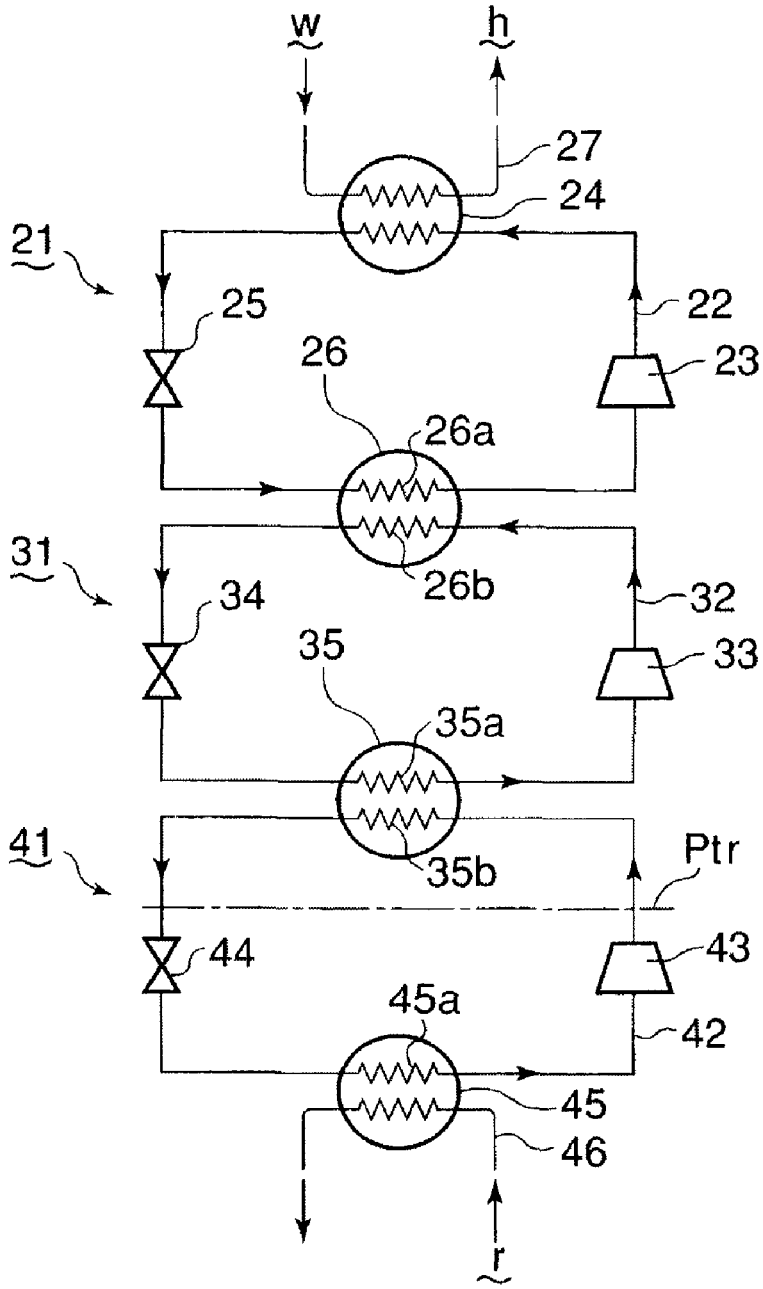
FIG. 5 is a block diagram of a third embodiment of the apparatus according to the present invention.

The third embodiment will be explained with reference to FIG. 5. In the third embodiment, a first refrigerating cycle circuit 21 includes a compressor 23, a condenser 24, an expansion valve 25, an evaporating part 26*a* of a first cascade condenser 26, and a first refrigerant flow path 22, with $CO_2$ as a refrigerant. A second refrigerating cycle circuit 31 and a third refrigerating cycle circuit 41 are also provided, which are explained below. In the first refrigerant cycle circuit 21, the $CO_2$ refrigerant is compressed adiabatically by the compressor 23 to the supercritical region of $CO_2$, then cooled in the condenser 24 by water w, then expanded adiabatically through the expansion valve 25, then introduced to the evaporating part 26*a* of the first cascade condenser 26. In the first cascade condenser 26, the refrigerant flash evaporated through the expansion valve receives heat from the refrigerant of the second refrigerating cycle circuit 31 flowing in a condensing part 26*b* of the first cascade condenser 26 to be fully evaporated, and the refrigerant vapor returns to the compressor 23. Water w flowing in a hot-water supply line 27 is heated in the condenser to about 80° C., and heated water h is supplied to heating loads not shown in the drawing.

The second refrigerating cycle circuit 31 can use ammonia or HC or $CO_2$ as a refrigerant. The second refrigerating cycle circuit includes a compressor 33, a condensing part 26*b* of the first cascade condenser 26, an expansion valve 34, an evaporating part 35*a* of a second cascade condenser 35, and a second refrigerant flow path 32. In the second refrigerating cycle circuit 31, the refrigerant compressed by the compressor 33 is introduced to the condensing part 26*b* of the first cascade condenser 26, where the refrigerant is cooled by the $CO_2$ refrigerant of the first refrigerating cycle circuit 21 flowing in the evaporating part 26*a* and condensed. The condensed refrigerant is expanded adiabatically through the expansion valve 34 to be flash evaporated, and flows into the evaporating part 35*a* of the cascade condenser 35. The flash evaporated refrigerant is fully evaporated in the evaporating part 35*a* of the cascade condenser 35 through heat received from the refrigerant of the third refrigerating cycle circuit flowing in a condensing part 35*b* of the cascade condenser 35, and the refrigerant vapor returns to the compressor 33. When a $CO_2$ refrigerant is used in the second refrigerating cycle circuit 31, the cycle circuit is operated under the pressure/temperature level above the $CO_2$ triple point.

The third refrigerating cycle circuit 41 uses $CO_2$ as a refrigerant. The cycle circuit includes a compressor 43, the condensing part 35*b* of the cascade condenser 35, an expansion valve 44, a sublimation heat exchanger 45, and a third refrigerant flow path 42. In the third refrigerating cycle circuit 41, the $CO_2$ refrigerant is expanded through the expansion valve 44 to a pressure/temperature level below the $CO_2$ triple point and reduced to a two-phase mixture of solid $CO_2$ and $CO_2$ gas. The solid $CO_2$ is sublimated in the sublimating part 45*a* of the sublimation heat exchanger 45 through heat received from cooling fluid r supplied through a cooling load line 46, and cooling fluid r can be cooled to very low temperature of −56° C.~−78° C.

According to the third embodiment, heated water of about 80° C. for hot-water supply and cooling fluid of a very low temperature of −56° C.~−78° C. for cooling loads can be produced simultaneously. As the first refrigerating cycle circuit 21 and the second refrigerating cycle circuit 31 are operated in the region of pressure/temperature above the $CO_2$ triple point, solid $CO_2$ does not develop and increase in refrigerant flow resistance or clogging does not occur, and stable refrigerating operation is assured. As the second refrigerating cycle circuit 31 is operated using ammonia or HC as a refrigerant, the cycle circuit can be operated with high efficiency.

Figure 6:
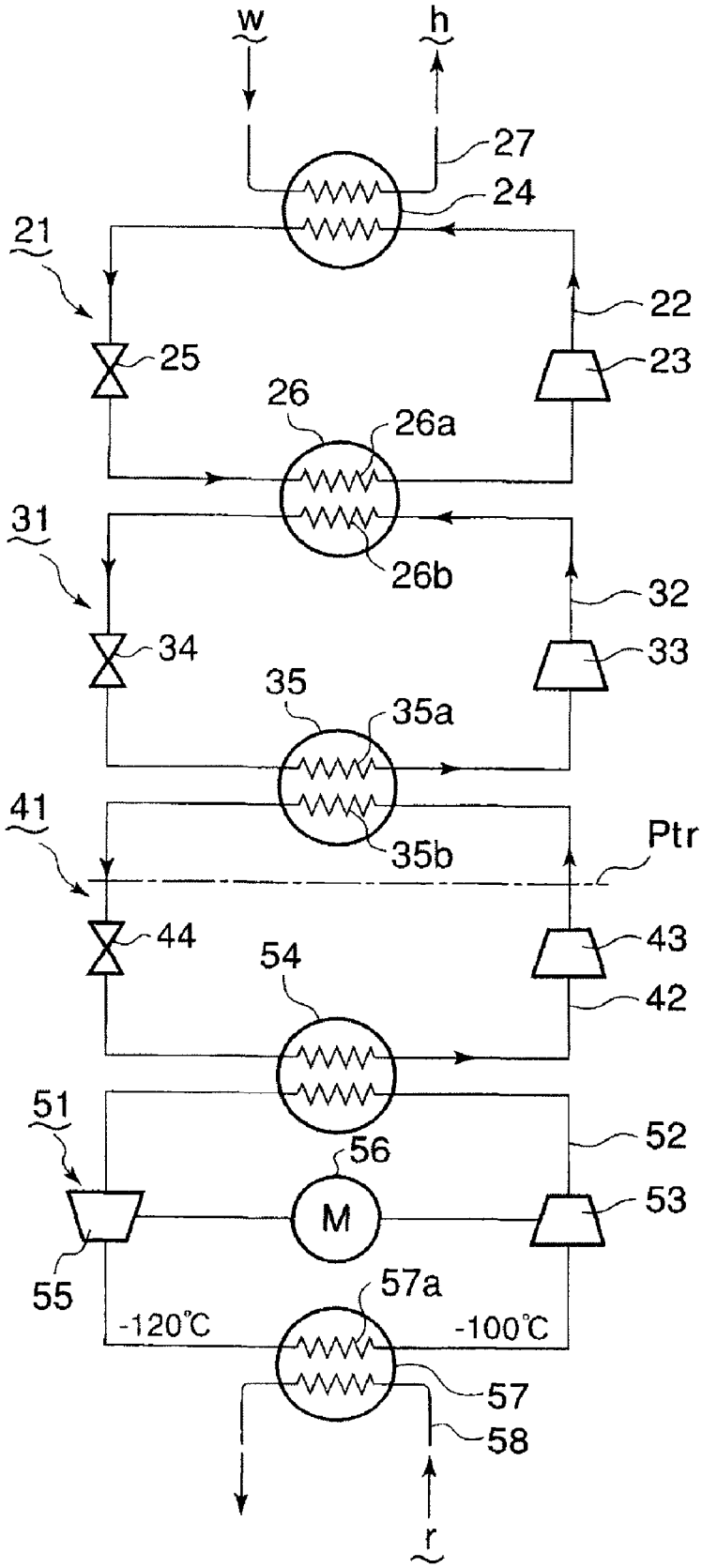
FIG. 6 is a block diagram of a fourth embodiment of the apparatus according to the present invention.

The fourth embodiment will be explained with reference to FIG. 6, FIG. 7A, and FIG. 7B. In the fourth embodiment further adds to the third embodiment shown in FIG. 5, a fourth refrigerating cycle circuit 51 in which CH gas or air or nitrogen gas can be used as a refrigerant, thereby enabling supply of extremely low temperature cold heat source. In FIG. 6, devices and parts denoted with reference numerals the same as those of the third embodiment shown in FIG. 5 have the same construction and function as those in the third embodiment, and thus explanation has been omitted. The fourth refrigerating cycle circuit 51 uses air or nitrogen as a refrigerant, and the cycle circuit includes a compressor 53, a third cascade condenser 54 instead of the sublimation heat exchanger 45 of the third embodiment of FIG. 5, an expansion turbine 55, a sublimation heat exchanger 57, and a fourth refrigerant flow passage 52. Reference numeral 56 is a drive motor for driving the compressor 53. The drive motor 56 is composed as a recovery motor driven by the expansion turbine 55.

In the fourth refrigerating cycle circuit 51, the refrigerant compressed by the compressor 53 is cooled in the third cascade condenser 54 by the refrigerant of the third refrigerating cycle circuit 41. The cooled refrigerant then expands adiabatically in the expansion turbine 55 to be reduced in temperature to −120° C. and introduced to the sublimation heat exchanger 57, where the refrigerant is sublimated through receiving heat from cooling fluid r supplied through a cooling load line 58, and cooling fluid r is cooled to an extremely low temperature of approximately −100° C.

Figure 7A:
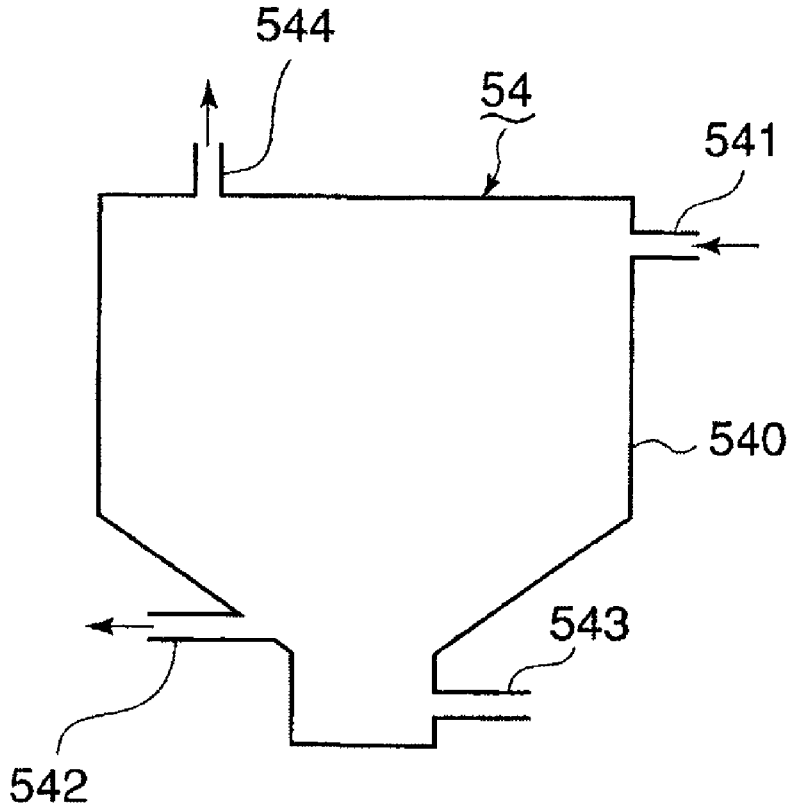
FIG. 7A is a schematic elevational view of the cascade condenser 54 of the fourth embodiment.
Figure 7B:
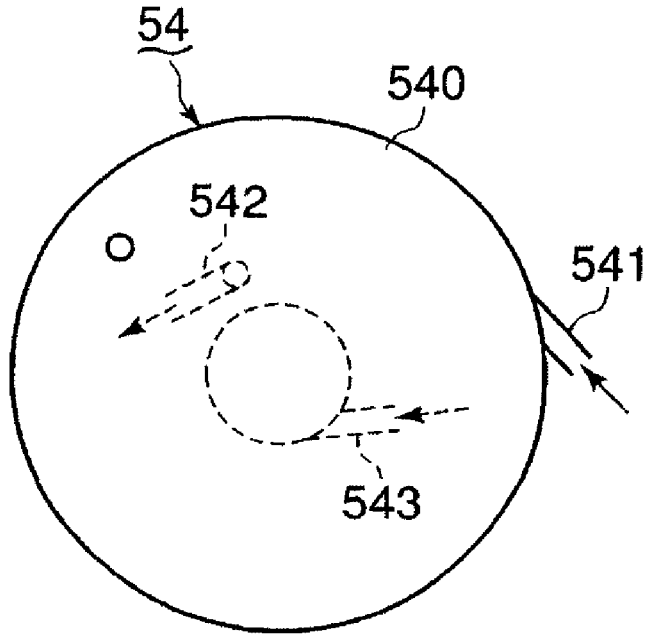
FIG. 7B is a schematic plan view of the cascade condenser 54 of the fourth embodiment.

In FIGS. 7A and 7B, which show the third cascade condenser 54 in elevation and plan view respectively. The third cascade condenser 54 is formed into a cyclone 540 having an inside hollow space. An inlet pipe 541 for introducing the $CO_2$ refrigerant of the third refrigerating cycle circuit 41 is provided horizontally and tangentially to the cyclone 540 at an upper part thereof. An inlet pipe 543 for introducing the refrigerant (CH gas or air or nitrogen gas) of the fourth refrigerating cycle circuit is provided horizontally and tangentially to the cyclone 540 at a lower part thereof. An outlet pipe 542 of the $CO_2$ refrigerant is provided horizontally and tangentially to the cyclone 540 at a lower part thereof, and an outlet pipe 544 of the air or nitrogen refrigerant is provided at the top of the cyclone 540. The molecular weight of $CO_2$ at 44 is heavier than that of air and nitrogen. Accordingly, the $CO_2$ refrigerant introduced into the cyclone 540 through the inlet pipe 541 flows down spirally along the inside wall of the cyclone 540 in a two-phase mixture state of solid $CO_2$ and $CO_2$ gas.

On the other hand, air or nitrogen introduced into the cyclone through the inlet pipe 543 flows upward spirally in the cyclone as it is lighter than the $CO_2$ refrigerant. The $CO_2$ refrigerant and air or nitrogen are introduced into the cyclone 540 so that they swirl in counter direction to each other and they flow out through the outlet pipes 544 and 542, respectively. As the third cascade condenser 54 is a direct contact type heat exchanger as explained above, it is superior in heat exchange efficiency. As the $CO_2$ refrigerant and air or nitrogen differ significantly in specific weight, they separate easily from each other in the cyclone 540 to flow out from the outlet pipe 544 and 542 respectively. According to the fourth embodiment, hot water of about 80° C. and an extremely low temperature cold source of −100° C. or below can be supplied simultaneously, resulting in the apparatus that is high in efficiency, and stable in operation can be provided.

Figure 8:
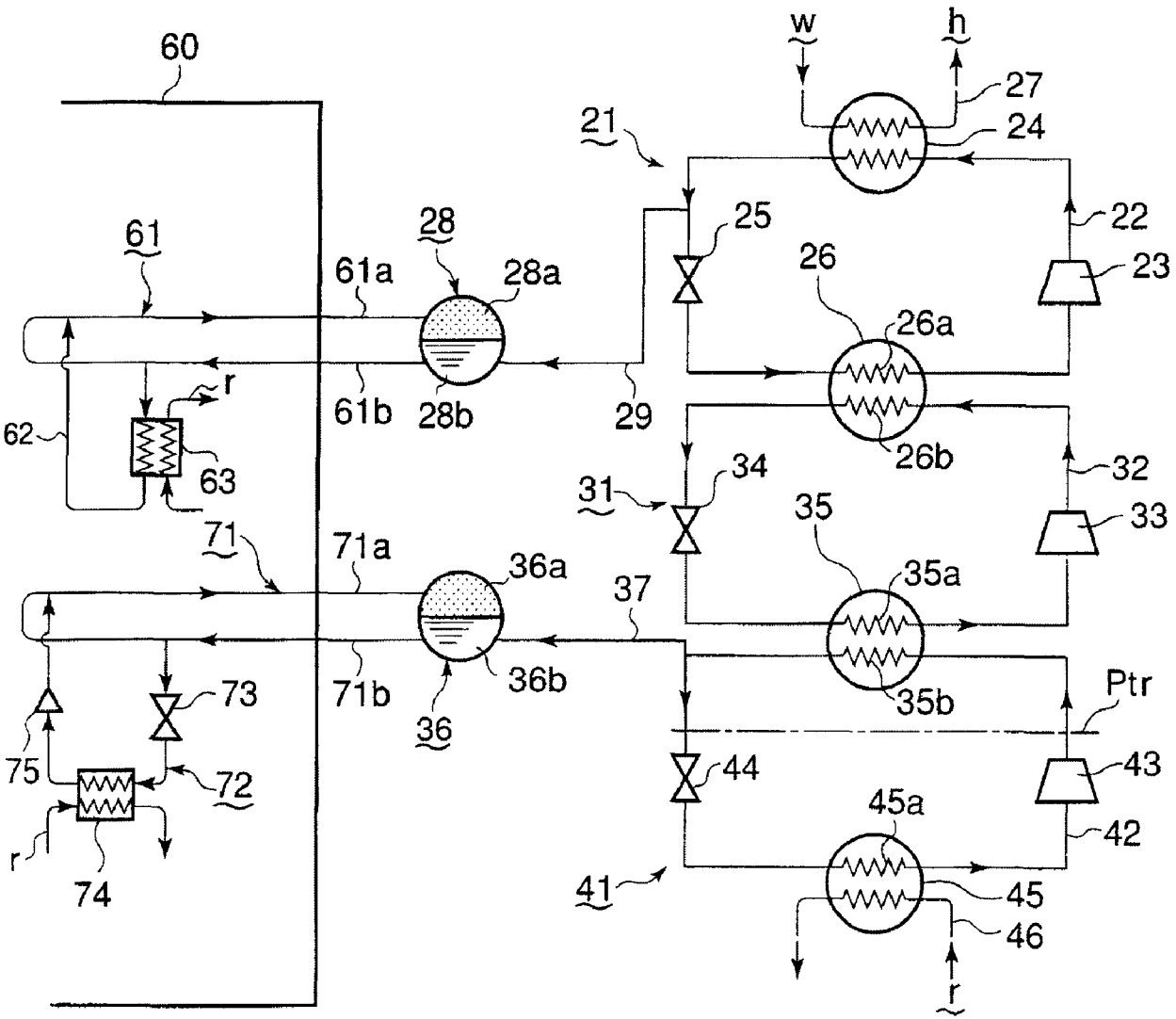
FIG. 8 is a block diagram of a fifth embodiment of the apparatus according to the present invention.

The fifth embodiment will be explained with reference to FIG. 8. In the fifth embodiment, the first refrigerating cycle circuit 21, the second refrigerating cycle circuit 31, and the third refrigerating cycle circuit 41 are composed the same as those of the third embodiment of FIG. 5. Accordingly, the same reference numerals are used, and explanation thereof have been omitted. In FIG. 8, reference numeral 28 and 36 are a gas-liquid separator, respectively. A liquid phase part 28*b* in the separator 28 is communicated through a branch path 29 to the first refrigerant flow path 22 at a point upstream of the expansion valve 25 via a branch path 29. A liquid phase part 36*b* in the separator 36 is communicated through a branch path 37 to the third refrigerant flow path 42 at a point upstream of the expansion valve 44.

Reference numerals 61 and 71 are respectively a closed loop for supplying cooling fluid located substantially horizontally in a building 60 such as a hospital, hotel, restaurant, and the like. The closed loop 61 is formed by connecting a gas line 61*a* thereof to a gas phase part 28*a* in the gas-liquid separator 28 and connecting a liquid line 61*b* to the liquid phase part 28*b* in the separator 28. The closed loop 71 is formed by connecting a liquid line 71*a* thereof to a gas phase part 36*a* in the gas-liquid separator 36 and connecting a liquid line 71*b* to the liquid phase part 36*b* in the separator 36. Refrigerants flow in the direction of arrows in the closed loop 61 and 71. A heat exchanger 63 is provided in a refrigerant circuit 62 connecting the liquid line 61*b* to the gas line 61*a*. The liquid refrigerant flowing in the liquid line 61*b* is introduced to the heat exchanger 63 where the liquid refrigerant is evaporated through heat received from cooling fluid r which has cooled cooling loads not shown in the drawing and the evaporated refrigerant returns to the gas line 61*a* of the closed loop 61.

A refrigerant circuit 72, provided with an expansion valve 73 and a heat exchanger 74, is provided between the liquid line 71*b* and gas line 71*a* to constitute a refrigerating cycle circuit. The $CO_2$ refrigerant liquid taken out from the liquid line 71*b* expands adiabatically through the expansion valve 73 to be flash evaporated and the flash evaporated refrigerant is evaporated in the heat exchanger 74 through heat received from cooling fluid r, which has cooled cooling loads not shown in the drawing, and the evaporated refrigerant returns to the gas line 71*a* of the closed loop 71. The closed loops 61 and 71 are disclosed in Japanese Laid-Open Patent Application No. 2003-329318, the disclosure of which is incorporated herein by reference.

According to the fifth embodiment, hot water of about 80° C. and an extremely low temperature cold source of near −80° C. can be supplied simultaneously and can meet various demands of heat source and cold source for a buildings, such as hospitals, hotels, restaurants, and the like. Refrigerants supplied to the closed loops 61 and 71 in buildings are $CO_2$, which is a natural refrigerant, innoxious, and safe in refrigeration operation. As the first and second refrigerating cycles are operated above the pressure/temperature level of the $CO_2$ triple point and refrigerants flows in the closed loops 61, 71 located in buildings in a pressure/temperature level above the $CO_2$ triple point, increase in flow resistance or clogging in the refrigerant passages does not occur, and stable and efficient operation can be achieved.

The $CO_2$ apparatus can have an improved coefficient of performance with stable control of operation, and is capable of supplying high temperature hot water and extremely low temperature cold source simultaneously, thereby meeting various demands for heat source and cold source in a hospital, hotel, restaurant, or the like.

According to one configuration disclosed above, high temperature water of about 80° C., for example, can be supplied, as well as cooling fluid of −56° C.~−80° C., for example, can be supplied to cooling loads. The apparatus can have a first refrigerating cycle circuit and a second refrigerating cycle circuit. The first refrigerating cycle circuit can include a $CO_2$ refrigerant flow path, a plurality of compressors connected in series to pressurize $CO_2$ to the supercritical region of $CO_2$, a condenser for cooling the pressurized $CO_2$, an intermediate cooler for further cooling the condensed $CO_2$, an expansion valve through which the further cooled and condensed $CO_2$ can be reduced to a pressure/temperature level of the $CO_2$ triple point or below to be reduced to a mixture of solid $CO_2$ and $CO_2$ gas, and an evaporator for sublimating the solid $CO_2$ in the mixture. The sublimated $CO_2$ gas can be introduced into the lowest pressure stage compressor among the plurality of the compressors, and the second refrigerating cycle circuit can be formed by providing a branch path branching off the $CO_2$ refrigerant flow path at a point between the condenser, the intermediate cooler, and an expansion device provided in the branch path so that a part of the cooled $CO_2$ flowing out of the condenser can be introduced via the expansion device to the intermediate cooler to be further cooled and evaporated therein, and the vaporized $CO_2$ can be introduced into one of said compressors between the highest pressure stage compressor and the lowest pressure stage compressor. Thus, the second refrigerating cycle circuit can be operated above the pressure/temperature level of the $CO_2$ triple point.

The second refrigerating cycle circuit can be operated in the pressure/temperature level above the $CO_2$ triple point, so that solid $CO_2$ is not produced, to thereby prevent flow resistance or blockage in the expansion device. The apparatus thus can be operated stably. Further, by using a plurality of compressors connected in series, the coefficient of performance of the refrigerating cycle can be increased. By adopting a capillary tube or expansion turbine as an expansion device in a cycle in which the $CO_2$ refrigerant is reduced to the pressure/temperature level of the $CO_2$ triple point to be in a state of a mixture of solid $CO_2$ and $CO_2$ gas, to prevent flow resistance or clogging in the refrigerant flow path.

According to the another configuration, again both high temperature water and very low temperature cooling fluid can be supplied to cooling loads as is in the first configuration by composing a $CO_2$ apparatus with combined refrigerating cycles comprising a first refrigerating cycle circuit, a second refrigerating circuit, and a third refrigerating circuit. In the first refrigerating cycle circuit, a $CO_2$ refrigerant is compressed to the supercritical region of $CO_2$, the compressed $CO_2$ is cooled and condensed in a condenser, the condensed $CO_2$ is expanded via an expansion device and evaporated in an evaporating part of a first cascade condenser, and the vaporized $CO_2$ refrigerant is again compressed to the supercritical region of $CO_2$, the cycle circuit being operated above the pressure/temperature level of the $CO_2$ triple point. In the second refrigerating cycle circuit, which can use ammonia, HC, or $CO_2$ as a refrigerant, the refrigerant is compressed, the compressed refrigerant is cooled and condensed in a condensing part of the first cascade condenser. The condensed refrigerant can be expanded via an expansion device and evaporated in an evaporating part of a second cascade condenser. The vaporized refrigerant can be again compressed, the cycle circuit being operated above a pressure/temperature level of $CO_2$ triple point. In the third refrigerating cycle circuit, a $CO_2$ refrigerant is compressed, the compressed $CO_2$ can be cooled and condensed in a condensing part of the second cascade condenser, the condensed $CO_2$ can be expanded via an expansion device to the pressure/temperature level of the $CO_2$ triple point or below to be reduced to a mixture of solid $CO_2$ and $CO_2$ gas, the solid $CO_2$ can be sublimated in a sublimation heat exchanger, and the sublimated $CO_2$ gas can be again compressed.

As the first and second refrigerating cycles can be operated in a pressure/temperature level of above the $CO_2$ triple point, increase in flow resistance or occurrence of clogging in the refrigerant flow path can be prevented. When using ammonia or HC refrigerant in the second refrigerating cycle circuit, the refrigerating efficiency can be further increased. When using $CO_2$ refrigerant in the second refrigerating cycle circuit, advantage of natural refrigerant $CO_2$ that it is safe and innoxious can be obtained, and as the same refrigerant can be used in the first and third refrigerating cycles, the apparatus can be reduced in total cost.

By further adding a fourth refrigerating cycle circuit in which CH gas, air or nitrogen gas can be used as a refrigerant, and the sublimation heat exchanger of the third refrigerating cycle circuit can be used as a third cascade condenser, it is possible to supply cooling fluid further decreased in temperature for example to about −120° C. By composing the first to third cascade condensers as direct contact type heat exchangers in which heat exchange is performed by direct contact of higher-temperature side refrigerant with lower-temperature side refrigerant, heat exchange efficiency can be increased.

By further adding a closed loop located substantially horizontally to which the liquid phase refrigerant of the first or third refrigerating cycle circuit can be introduced or closed loops each located substantially horizontally to each of which is introduced the liquid phase refrigerant of each of the first and third refrigerating cycles respectively, and a refrigerant path provided with a heat exchanger can be connected to each closed loop so that liquid phase refrigerant in a liquid phase line part of the closed loop is introduced to the heat exchanger to be evaporated there and the vaporized refrigerant is returned to a gas phase line part of the closed loop, hot water and cooling fluid can be supplied to hospitals, hotels, or restaurants where a variety of heat sources and cold sources are demanded. As $CO_2$, which is a natural refrigerant, circulates in the refrigerant paths connected to the closed loops, safety in the building can be secured.

Further, by providing a gas-liquid separator between the closed loop and the liquid phase refrigerant flowing part of the refrigerant flow path of the first refrigerating cycle circuit and/or the third refrigerating cycle circuit respectively, $CO_2$ in the liquid phase can be introduced positively to the closed loop.

The expansion device can be a capillary tube, expansion turbine, or expansion valve, or any known devices that allows expansion of the refrigerant.

While the present invention has been particularly shown and described with reference to preferred embodiments thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

What is claimed is:

1. A $CO_2$ cooling and heating apparatus comprising:

a first refrigerating cycle circuit comprising:

a first refrigerant flow path;

a first compressor in the first refrigerant flow path for pressurizing a $CO_2$ refrigerant to the supercritical region of $CO_2$;

a condenser in the first refrigerant flow path downstream from the first compressor for condensing the pressurized refrigerant;

a first intermediate cooler in the first refrigerant flow path downstream of the condenser for further cooling the condensed refrigerant;

a first expansion device in the first refrigerant flow path downstream of the first intermediate cooler for further cooling and condensing the refrigerant to a pressure/temperature level of the $CO_2$ triple point or below to reduce the refrigerant to a mixture of solid $CO_2$ and $CO_2$ gas;

an evaporator in the first refrigerant flow path downstream of the first expansion device for sublimating the solid $CO_2$ in the mixture;

a second compressor in the first refrigerant flow path downstream of the evaporator for compressing the refrigerant, wherein the refrigerant compressed by the second compressor is introduced into the first compressor; and a second refrigerating cycle circuit comprising:

a second refrigerant flow path including a first branch path branching off the first refrigerant flow path at a point between the condenser and the first intermediate cooler;

a second expansion device in the second refrigerant flow path for further cooling and evaporating part of the refrigerant from the condenser; and the first intermediate cooler also in the second refrigerant flow path for further cooling the refrigerant in the first refrigerant flow path and for evaporating the refrigerant in the second refrigerant flow path by heat exchange, wherein the refrigerant passing through the second expansion device is introduced into the first intermediate cooler in the second refrigerant flow path, and wherein the refrigerant passing through the first intermediate cooler is introduced to the first refrigerant flow path between the first compressor and the second compressor so that the second refrigerating cycle circuit operates above the pressure/temperature level of the $CO_2$ triple point.

2. The $CO_2$ cooling and heating apparatus according to claim 1, further comprising:

a second intermediate cooler in the first refrigerant flow path between the first intermediate cooler and the first expansion device;

a third compressor in the first refrigerant flow path between the first and second compressors; and a third refrigerating cycle circuit comprising:

a third refrigerant flow path including a second branch path branching off the first refrigerant flow path at a point between the first intermediate cooler and the second intermediate cooler;

a third expansion device in the third refrigerant flow path for further cooling and evaporating part of the refrigerant from the first intermediate cooler in the path of the first refrigerant flow path, the second intermediate cooler also in the third refrigerant flow path for further cooling the refrigerant in the first refrigerant flow path and for evaporating the refrigerant in the third refrigerant flow path by heat exchange, wherein the refrigerant passing through the third expansion device is introduced into the first intermediate cooler in the third refrigerant flow path, and wherein the refrigerant passing through the second intermediate cooler is introduced to the first refrigerant flow path between the second compressor and the third compressor so that the third refrigerating cycle circuit operates above the pressure/temperature level of the $CO_2$ triple point.

3. The $CO_2$ cooling and heating apparatus according to claim 1, wherein the first and second compressors are connected in series.

4. The $CO_2$ cooling and heating apparatus according to claim 2, wherein the first, second, and third compressors are connected in series.

5. The $CO_2$ cooling and heating apparatus according to claim 1, wherein the first expansion device comprises an expansion valve and the second expansion device comprises a capillary tube or an expansion turbine.

6. The $CO_2$ cooling and heating apparatus according to claim 2, wherein the first expansion device comprises an expansion valve and the second and third expansion devices each comprise a capillary tube or an expansion turbine.

7. The $CO_2$ cooling and heating apparatus according to claim 1, wherein the condenser comprises a heat exchanger that supplies heated water, and wherein the evaporator comprises a heat exchanger that supplies cooling fluid.

8. A $CO_2$ cooling and heating apparatus comprising:

a first refrigerating cycle circuit comprising:

a first compressor for compressing a $CO_2$ refrigerant to the supercritical region of $CO_2$;

a condenser for condensing the refrigerant compressed by the first compressor;

a first expansion device for expanding the refrigerant condensed by the condenser; and a first cascade condenser having an evaporating part for vaporizing the refrigerant expanded by the first expansion device, wherein the first compressor compresses the refrigerant vaporized by the first cascade condenser to the supercritical region of $CO_2$ so that the first refrigerating cycle circuit operates above a pressure/temperature level of the $CO_2$ triple point;

a second refrigerating cycle circuit comprising:

a second compressor for compressing a refrigerant of ammonia, HC, or $CO_2$;

the first cascade condenser having a condensing part for condensing the refrigerant compressed by the second compressor;

a second expansion device for expanding the refrigerant condensed by the first cascade condenser; and a second cascade condenser having an evaporating part for vaporizing the refrigerant condensed by the second expansion device, wherein the second compressor compresses the refrigerant vaporized by the second cascade condenser so that the second refrigerating cycle circuit operates above the pressure/temperature level of the $CO_2$ triple point; and a third refrigerating cycle circuit comprising:

a third compressor for compressing a $CO_2$ refrigerant;

the second cascade condenser having a condensing part for condensing the refrigerant compressed by the third compressor;

a third expansion device for expanding the refrigerant condensed by the second cascade condenser to the pressure/temperature level of the $CO_2$ triple point or below to reduce the refrigerant to a mixture of solid $CO_2$ and $CO_2$ gas; and a sublimation heat exchanger for sublimating the solid $CO_2$, wherein the third compressor compresses the refrigerant sublimated by the sublimation heat exchanger.

9. The $CO_2$ cooling and heating apparatus according to claim 8, further including a fourth refrigerating cycle circuit that uses a refrigerant of CH gas or air or nitrogen gas, and includes the sublimation heat exchanger, which comprises a third cascade condenser that sublimates the solid $CO_2$ in the third refrigerating cycle circuit.

10. The $CO_2$ cooling and heating apparatus according to claim 8, wherein the first and second cascade condensers are direct contact type heat exchangers where heat exchange occurs from a direct contact of a higher-temperature side refrigerant with a lower-temperature side refrigerant.

11. The $CO_2$ cooling and heating apparatus according to claim 9, wherein the first, second, and third cascade condensers are direct contact type heat exchangers where heat exchange occurs from a direct contact of a higher-temperature side refrigerant with a lower-temperature side refrigerant.

12. The $CO_2$ cooling and heating apparatus according to claim 8, further comprising:

a closed circuit for receiving the refrigerant in liquid phase from the first or third refrigerating cycle circuit; and a refrigerant path provided with a heat exchanger connected to the closed circuit, wherein the closed circuit has a liquid phase line part and a gas phase line part, wherein the liquid phase line part supplies the refrigerant in liquid phase to the heat exchanger, which vaporizes the refrigerant in liquid phase, and wherein the gas phase line part returns the vaporized refrigerant from the heat exchanger.

13. The $CO_2$ cooling and heating apparatus according to claim 12, wherein the closed circuit is provided for each of the first and third refrigerating cycle circuits.

14. The $CO_2$ cooling and heating apparatus according to claim 12, further including a gas-liquid separator in the closed circuit between the gas phase line part and the liquid phase line part.

15. The $CO_2$ cooling and heating apparatus according to claim 13, further including a gas-liquid separator in each of the closed circuits between the gas phase line part and the liquid phase line part.

16. The $CO_2$ cooling and heating apparatus according to claim 8, wherein the first, second, and third expansion devices each comprises one of an expansion valve, a capillary tube, or an expansion turbine.

17. The $CO_2$ cooling and heating apparatus according to claim 8, wherein the condenser comprises a heat exchanger that supplies heated water, and wherein the sublimation heat exchanger supplies cooling fluid.

18. A method of cooling and heating fluid comprising the steps of:

providing at least first and second refrigerating cycle circuits;

operating one of the first and second refrigerating cycle circuits with a $CO_2$ refrigerant to achieve a pressure/temperature level above the $CO_2$ triple point so that solid $CO_2$ is not produced;

operating the other of the first and second refrigerating cycle circuits with a $CO_2$ refrigerant to achieve a pressure/temperature level of the $CO_2$ triple point or below to reduce $CO_2$ to a two-phase mixture of solid $CO_2$ and $CO_2$ gas;

exchanging heat between the refrigerants in the first and second refrigerating cycle circuits to evaporate the refrigerant in the one circuit and evaporate the refrigerant in the other circuit;

exchanging heat between the refrigerant in the one circuit and fluid to be heated to obtained heated fluid; and exchanging heat between the refrigerant in the other circuit and fluid to be cooled to obtain cooled fluid, wherein the heated fluid and the cooled fluid are simultaneously obtained.

* * * * *